United States Patent [19]

Kuboki et al.

[11] Patent Number: 4,748,046

[45] Date of Patent: May 31, 1988

[54] METHOD OF MAKING KEYS OF A KEYBOARD

[75] Inventors: Yoshitomo Kuboki; Mitsuhiro Okada; Hiroo Ookoshi, all of Iwaki, Japan

[73] Assignee: Alps Electric Co., Ltd., Japan

[21] Appl. No.: 17,989

[22] Filed: Feb. 24, 1987

[30] Foreign Application Priority Data

Jun. 24, 1986 [JP] Japan ..... 61-146243

[51] Int. Cl.[4] ..... B05D 3/06

[52] U.S. Cl. ..... 427/54.1; 427/258; 427/407.1

[58] Field of Search ..... 427/54.1, 258, 407.1

[56] References Cited

U.S. PATENT DOCUMENTS

| | | | |
|---|---|---|---|
| 4,105,816 | 8/1978 | Hori | 427/428 X |
| 4,122,225 | 10/1978 | Holmstrom et al. | 427/54.1 X |

FOREIGN PATENT DOCUMENTS

| | | | |
|---|---|---|---|
| 53-16402 | 6/1978 | Japan | 427/258 |
| 53-105542 | 9/1978 | Japan | 427/258 |
| 58-82756 | 5/1983 | Japan | 427/258 |
| 59-171418 | 9/1984 | Japan | 427/54.1 |

*Primary Examiner*—Thurman K. Page

*Attorney, Agent, or Firm*—Guy W. Shoup

[57] ABSTRACT

A method of making any key of a keyboard having a top surface on which a symbol is formed by padding. An ultraviolet-curing resin is applied by padding to only the surface of a material forming the symbol to form an overcoating layer covering only the surface of the symbol. The layer is cured by ultraviolet radiation.

4 Claims, 2 Drawing Sheets

METHOD OF MAKING KEYS OF A KEYBOARD

BACKGROUND OF THE INVENTION

1. Field of the Invention

This invention relates to a method of making the keys of a keyboard for a personal computer, etc. More particularly, it is a method of making any such key having a top surface carrying a letter, symbol or the like formed by padding.

2. Description of the Prior Art

The keyboard of, for example, a computer has a set of keys each carrying a letter, numeral or symbol on its top surface. As the operator of the keyboard presses the top surfaces of the keys repeatedly, however, the letters, etc. are likely top be rubbed away sooner or later. Therefore, there is known a keyboard in which each key has a top surface overcoated to make it resistant to wear.

FIG. 3 shows a method of overcoating the top surface of a key. The to surface of the key 21 has a letter, symbol or the like formed by padding, but not shown. An ultraviolet-curing resin 22 is sprayed against the top surface of the key 21 and ultraviolet rays are radiated on the resin to cure it to form an overcoating layer on the top surface of the key 21.

This method, however, has a number of drawbacks. When the resin 22 is sprayed, it not only coats the top surface of the key 21, but also reaches the side face thereof which does not require overcoating. This means a waste of the resin. Moreover, the resin gathers dust or other foreign matter from its environment. An overcoating layer containing dust, etc. presents an unpleasant appearance.

SUMMARY OF THE INVENTION

It is, therefore, an object of this invention to provide a method which can make a key having a top surface covered with an overcoating layer of improved quality at a high yield.

This object is attained by a method which comprises applying by padding an ultraviolet-curing resin to only that portion of the top surface of a key which presents a letter, symbol or the like formed by padding.

According to this invention, the overcoating layer of the resin, as well as the letter, etc. per se, is formed by padding. The resin layer is formed only on that portion of the key with which a pad is brought into contact. The resin does not reach the side face of the key, nor does it scatter around the key. Therefore, no resin is wasted. Moreover, the resin which is applied by padding hardly gathers any dust or other foreign matter, but forms a layer having a greatly improved finish. Therefore, the method of this invention can produce a key of high quality at a low cost.

DETAILED DESCRIPTION OF THE INVENTION

Figure 1A:
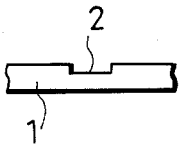
FIG. 1 shows a series of steps which constitutes a method embodying this invention.
Figure 1B:
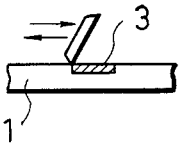
Figure 1C:
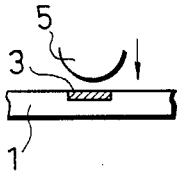
Figure 1D:
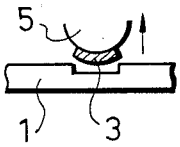
Figure 1E:
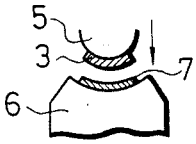
Figure 1F:
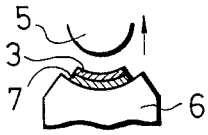
Figure 1G:
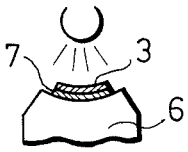
Figure 2:
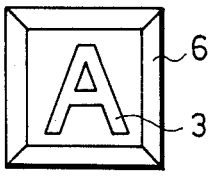
FIG. 2 is a top plan view of a key made by the method of this invention.
Figure 3:
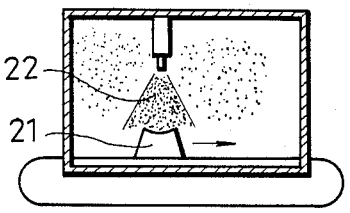
Fig. 3 PRIOR ART
FIG. 3 is a view showing the known method which has hereinabove been described.

A method embodying this invention is shown by way of example in FIG. 1. It is a method of making a key 6 having a top surface on which the letter A is formed by padding and overcoated with a layer of an ultraviolet-curing resin 3, as shown in FIG. 2. The letter is shown at 7.

The method employs an etching plate 1 having an etching groove 2, as shown at (A) in FIG. 1. The groove 2 is filled with a mixture of the ultraviolet-curing resin 3 and silica powder 4, as shown at (B) in FIG. 1. A pad 5 of silicone rubber is brought into contact with the resin 3 to draw the resin 3 out of the groove 2, as shown at (C) and (D). The key 6 is placed below the pad 5 as shown at (E) and the pad 5 is pressed against the top surface of the key 6, whereby the resin 3 is transferred onto the letter 7, as shown at (F).

The resin 3 is of the solventless type. As there is no solvent volatilization, the resin 3 in the etching groove 2 does not undergo any change in quantity, but forms a continuous layer having a uniform thickness.

An ordinary padding machine can be used for carrying out the process which has been described with reference to the views (A) to (F) of FIG. 1. Finally, the resin 3 is cured by ultraviolet radiation, as shown at (G) in FIG. 1. The overcoating layer formed by the method as hereinabove described has the shape of the letter A, as the pad 5 and hence the resin 3 are brought into contact with only the letter 7 on the top surface of the key 6. The resin 3 does not coat any other portion. The application of the resin by padding ensures that it hardly gather any dust or other foreign matter.

The thickness of the resin layer is easy to vary if the depth of the etching groove 2 is appropriately altered.

While the invention has been described with reference to a preferred embodiment thereof, it is to be understood that variations or modifications may be easily made by anybody of ordinary skill in the art without departing from the scope of this invention which is defined by the appended claims. The term "symbol" as used in the specification and particularly in the appended claims means a letter, numeral, figure or any other symbol used for making the keys to which this invention pertains.

What is claimed is:

1. A method of making a key of a keyboard having a top surface on which a symbol for the key is displayed, comprising:

applying a first pad having a selected shape and displaying the symbol on the top surface of the key;

forming a second pad of ultraviolet-curable resin corresponding to the selected shape of the first pad, and applying the second pad as a protective layer on the first pad; and curing the protective layer of the second pad on the first pad by ultraviolet radiation.

2. A method as set forth in claim 1, wherein said resin does not contain any solvent.

3. A method as set forth in claim 1, wherein said resin contains silica powder.

4. A method of making a key of a keyboard according to claim 1, wherein said step of forming and applying the second pad on the first pad includes:

preparing an etching plate having an etching groove formed therein of a shape corresponding to the selected shape of the first pad and having an appropriate depth;

filling said groove with a layer of an ultraviolet-curable resin to form the second pad;

bringing a transferring pad into contact with the second pad of resin to draw it out of said groove; and pressing said transferring pad with the second pad of resin thereon to transfer the second pad onto the first pad on the top surface of the key.

* * * * *